US005587192A

United States Patent [19]

Beizermann

[11] Patent Number: 5,587,192

[45] Date of Patent: Dec. 24, 1996

[54] VENTABLE CONTAINER

[75] Inventor: Michel Beizermann, Voiron, France

[73] Assignee: Societe de Constructions de Material Metallique, Renage, France

[21] Appl. No.: 314,858

[22] Filed: Sep. 29, 1994

[51] Int. Cl.[6] ..... B65D 81/34

[52] U.S. Cl. ..... 426/118; 426/113; 426/395; 426/396; 426/412; 220/366.1; 220/360; 220/364; 383/103

[58] Field of Search ..... 426/118, 395, 426/412, 113; 220/366, 366.1, 367.1, 364, 360, 361; 383/103

[56] References Cited

U.S. PATENT DOCUMENTS

| | | | |
|---|---|---|---|
| 2,361,344 | 10/1944 | Yates | 426/118 |
| 2,633,284 | 3/1953 | Moffett et al. | 426/118 |
| 2,807,550 | 9/1957 | Zarotschenzeff et al. | 426/118 |
| 3,432,087 | 3/1969 | Costello | 426/118 |
| 3,716,180 | 2/1973 | Bemiss et al. | 426/118 |
| 3,806,618 | 4/1974 | Bemiss | 426/118 |
| 3,937,396 | 2/1976 | Schneider | 426/118 |
| 3,997,677 | 12/1976 | Hirsch et al. | 426/118 |
| 4,141,487 | 2/1979 | Faust et al. | 426/118 |
| 4,206,870 | 6/1980 | De Vries | 426/118 |
| 4,358,466 | 11/1982 | Stevenson | 426/118 |
| 4,404,241 | 9/1983 | Mueller et al. | 426/118 |
| 4,571,337 | 2/1986 | Cage et al. | 426/118 |
| 4,640,838 | 2/1987 | Isakson et al. | 426/118 |
| 4,834,247 | 5/1989 | Oshima et al. | 220/366 |
| 5,039,001 | 8/1991 | Kinigakis et al. | 426/118 |
| 5,307,985 | 5/1994 | Beizermann | 426/118 |

FOREIGN PATENT DOCUMENTS

| | | |
|---|---|---|
| 2085439 | 6/1993 | Canada . |
| 0547941 | 6/1993 | European Pat. Off. . |
| 2629060 | 9/1989 | France . |
| 2635760 | 3/1990 | France . |

OTHER PUBLICATIONS

Central Patent Index, Basic Abstracts Journal Week 8245 Derwent Publications Ltd., London AN 82–95879E & JP–A 57 158 276 (Sekisui Chemi. Ind. KK) Sep. 1982.

*Primary Examiner*—Steven Weinstein
*Attorney, Agent, or Firm*—Pearne, Gordon, McCoy & Granger

[57] ABSTRACT

A ventable container comprises a body with a lip hermetically sealed by a film. A hole is provided in the lip of the container and a layer of hot melt adhesive disposed around the hole adhesively seals the film across the hole. When the container and the product are heat processed, the film flexes away from the tray, and the hot melt adhesive layer softens and releases the film for venting of the container. Upon cooling, the film once again bonds to the hot melt adhesive and seals the container.

5 Claims, 2 Drawing Sheets

VENTABLE CONTAINER

The present invention relates to gas tight containers of the "tray" variety, notably for food products or other products intended to undergo heat treatment.

In the food industry, cooked dishes are generally presented in packages formed by trays of aluminium foil, synthetic resin or various combinations such as cardboard with a film wrap.

The culinary preparations are cooked before being placed in the trays. The latter are sealed after cooking, which gives rise to the risks of soiling and contamination as a result of the transfer of the food.

FR-A-2 629 060 describes an automatic sealing device for packaging for food preparations intended for later consumption, using on the one hand the effects of expansion and escape of hot air or steam during the cooking operations, and on the other hand shrinkage during cooling, in order to achieve hermetic sealing of the packaging by means of a non-return valve whilst preventing the contamination and loss of flavour which occurs during the sealing. This device is characterised by the combination on the one hand of a volume formed by a double wall at the preferably axial part of a package with upper and lower perforations and on the other hand by the positioning of a non-return valve or sealing disc in the intercalary space; it should be pointed out that the disc has peripheral and other openings and is placed freely so as to move vertically downwards and upwards either to free the openings or to close them in a guided manner so as to prevent any lateral movement which could interfere with the evacuation and sealing. This device is very complicated to produce. In the alternative embodiment, in FIGS. 4, 5 and 6, further complications are envisaged, by applying a sticker, ie a support having a layer of adhesive such as a label to the inside of the non-return valves in order to prevent accidental opening caused by shock, deformation or the like during the conserving process. This sticker is intended to lose its sticking power in the heat and only stick after cooling. In another embodiment, in FIGS. 7, 8 and 9, the tray is sealed by a combination of two films adhering to one another apart from uncoated longitudinal strips. In the alternative embodiment shown in FIGS. 10, 11 and 12, the upper opening of a central tube is closed off or opened up by a sealing film which acts as a membrane. In a further variant in FIGS. 13, 14 and 15, an opening formed in the lip of the tray constitutes the seat for a valve closed off by the sealing film; the use of a fusible substance is not envisaged. The large number of alternative embodiments, none of which has come into common use, shows that research is still continuing into finding a safe but simple means of enabling air and steam trapped in the container to escape during cooking, when excess pressure prevails, whilst preventing the outside air from entering the tray during cooling when reduced pressure prevails inside, so that the food or other product is pasteurized or sterilized during cooking in a sterile container, thus ensuring that it will keep for several weeks, even without deep freezing or other additional measures, whilst maintaining the colour of the produce contained in the tray.

In order to achieve this French Patent Number 89 17 528 describes a tray provided with a tab hinged to the edge, this tab being folded inside after the food has been put in and before the covering film is sealed, said hinged tab, having on its horizontal surface a perforated seat in which is placed a drop of composite resin which become porous at a predetermined temperature.

However, this packaging requires, in addition to a resin which can become porous, a compact sealing tool which is capable of simultaneously heat-sealing the covering film all around the tray and all around the seat and of perforating the film at the precise point where the drop of fusible composite resin is located by means of a point provided for this purpose. Furthermore, the complexity of the tray itself makes it tricky and expensive to produce the mould and the articulated tab requires additional manipulation in order to position it.

The present application relates to a tray which overcomes these disadvantages. In fact, it does not require any articulated tab and is, therefore, simpler and less costly. The manufacturing mould is also cheaper to produce and the sealing tool does not require a point to perforate the film at the site of the drop of fusible resin, as sealing is carried out automatically simply by the effects of the heat treatment which a tray normally undergoes, following by cooling.

The container, according to the invention, comprises a body with a lip, hermetically sealed by a film and having a hole provided in the lip, characterised by a layer of a substance having a melting point of between 65° C. and 150° C., which is interposed between the film and the part of the lip around the hole.

The layer may be applied to the film or to the lip. The substance is preferably a fusible adhesive, particularly a food-quality adhesive, such as the food-quality hot melt glues of appropriate viscosity. These may be, in particular, hot melt adhesives based on terpene resin and/or vinyl. An example of a hot melt adhesive is as follows:

| | |
|---|---|
| Oil: | approx. 10% by weight |
| Terpene Phenolic Resin | approx. 50% by weight |
| Ethyl Vinyl Acetate (28% Vinyl Acetate) | approx. 25% by weight |
| Ethyl Vinyl Acetate (33% Vinyl Acetate) | approx. 5% by weight |
| Amorphous Polymer | approx. 10% by weight |

BRIEF DESCRIPTION OF THE DRAWINGS

In the accompanying drawings which are provided as a non-restrictive example of one of the embodiments of the object of the invention.

DETAILED DESCRIPTION OF THE DRAWINGS

Figure 1:
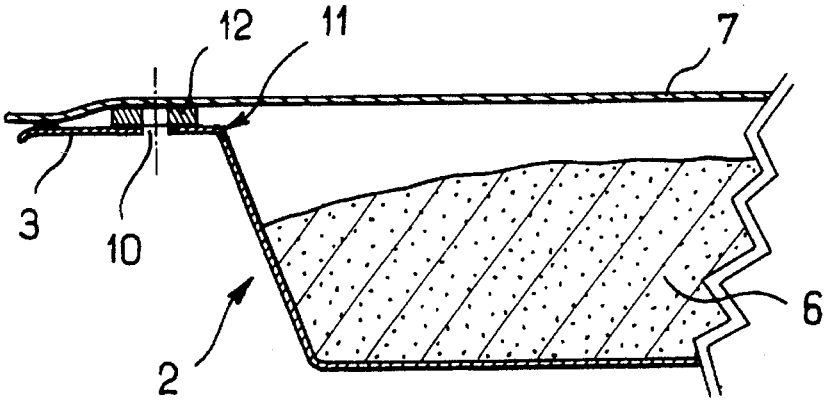
FIG. 1 shows a vertical section through a tray with a fusible resin arranged around the opening, before the cooking of the food preparation, FIGS. 2 and 3, respectively, show the same tray during the cooking of the product, with the fusible valve open, and after cooking, with the fusible valve closed.
Figure 2:
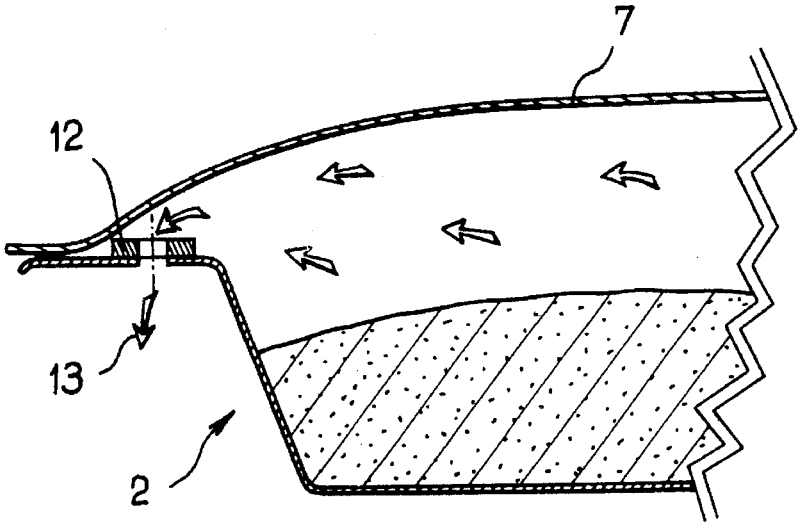
Figure 3:
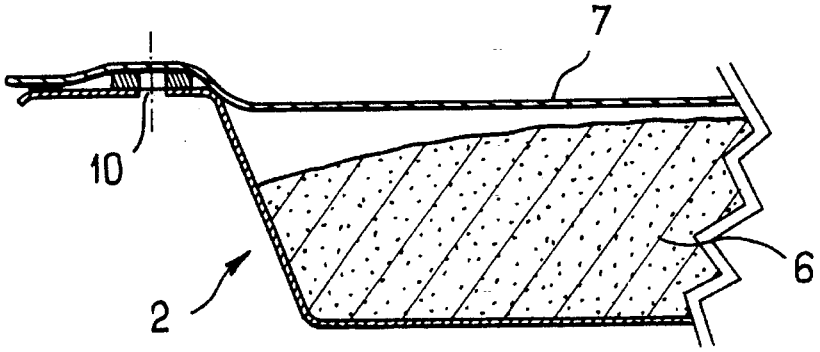

The tray shown in FIGS. 1 to 3, consists of a body 2 and a heat-fusible valve formed by a simple opening 10, having a diameter of 0.7 to 2 mm provided on the lip 3 of the body 2, preferably as close as possible to the inner edge 11, a fine layer of hot-melt resin 12 being deposited all around the opening on said lip.

Figure 4:
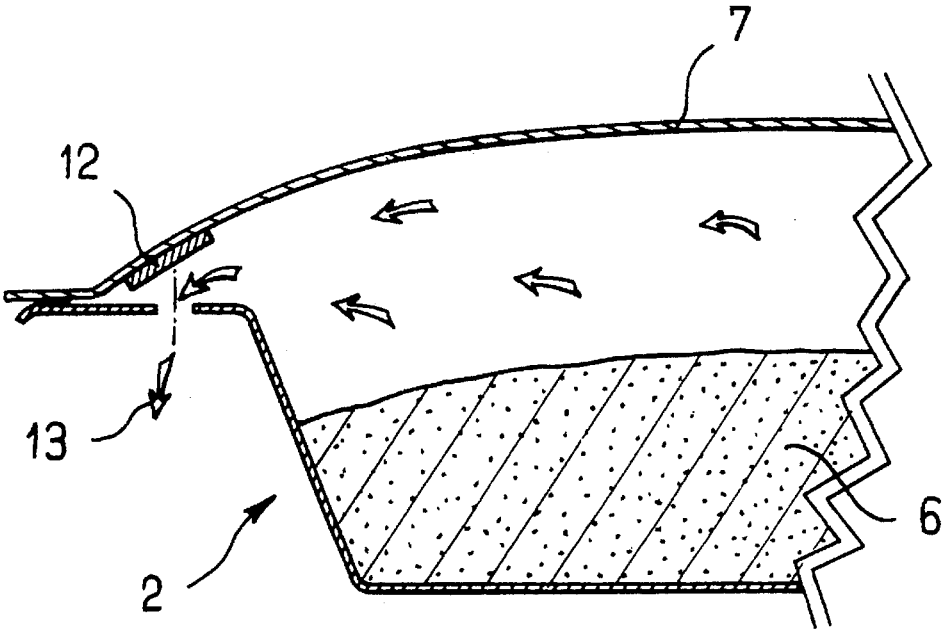
FIGS. 4 and 5 show, at the same stages as FIGS. 2 and 3, a tray with fusible resin arranged on the film which closes it.

After being filled with foodstuffs, the tray is sealed by means of a film 7 welded around the periphery of the tray. During the cooking or sterilization of the contents 6, the film 7 lifts under the effects of the excess pressure created on the inside, thus freeing the opening 10 and allowing the escape of gas (arrow 13, FIGS. 2 and 4) from the products and evacuation of the internal pressure in the tray which takes place through said opening whilst the hot-melt resin 12 is in liquid form. Thus, during the cooking phase, air, steam and gases 5 are able to escape through the fusible valve, the opening allowing the inside of the tray 2 to communicate with the outside.

Figure 5:
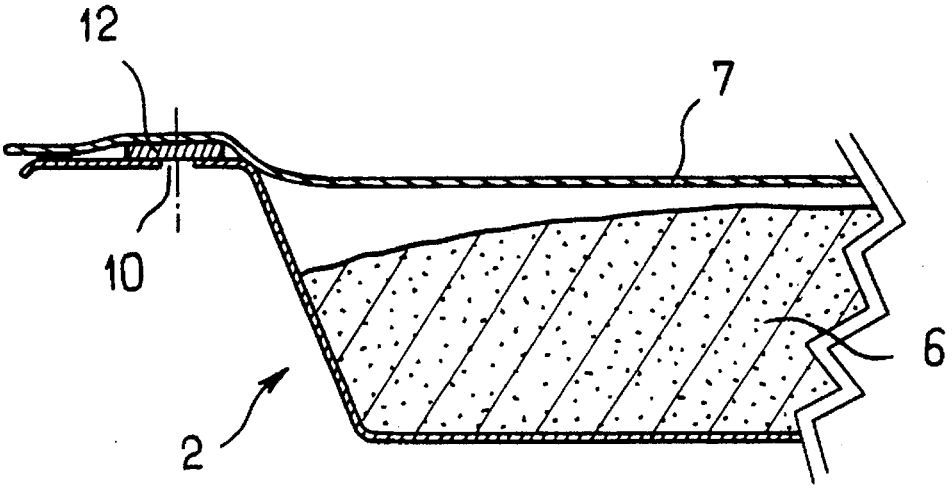

At the end of cooking or sterilization, rapid cooling is carried out by known means: cold air, spraying with ice-cold water or a cryogenic process. The effect of this operation is to create a vacuum inside the tray as a result of the temperature difference. While this substantial underpressure is present, the covering film 7 is sucked towards the inside of the tray and adheres to the inner edge 11 thereof, thereby covering the opening 10. The hot-melt resin 12 then ensures that the film adheres in leak-tight manner to the lip 3 of the tray, thereby preventing external air from entering (FIGS. 3 and 5).

In another embodiment, the fine layer of hot-melt resin may be applied to the inner surface of the film 7 either at marked locations corresponding to the positioning of the opening or openings 10 of the tray (FIGS. 4 and 5), or in a uniform coating over the entire surface of the film.

The vacuum created in the tray 2 by the temperature difference adds to the quality of the preservation of the food products, which are protected from the risk of oxidation. Thus, for example, green vegetables retain their colour perfectly.

I claim:

1. A container comprising a lower body including a tray having a recessed portion terminating at an upper lip that surrounds the tray, said recessed portion containing a product to be heat processed in the container, the lip having a flat configuration including an upper surface and an inner edge separating the tray from the upper surface of the lip, an upper film secured to the lower body by a first bond comprising a weld extending along a welding line on the upper surface of the lip so that the upper film hermetically seals the product in said lower body, a hole formed in the lip between the welding line and the inner edge of the lip, the hole being defined and surrounded by a portion of the upper surface of the lip and being closed by the film extending across the hole in sealing relationship, the film being flexible away from the tray in response to increased gas pressure within the container during heating of the product and a layer of hot melt adhesive having a melting point between 65° C. and 150° C. placed in spaced relation from said welding line and in interposition between the upper film and the portion of the upper surface of the lip that surrounds the hole, said layer releasably bonding said upper surface of the lip to the film to form a second bond between said upper surface of said lip and said film such that said film seals the hole and prevents gaseous communication between the hole and the recessed portion of the tray under temperature conditions less than said melting point and such that when said container and product are heat processed and said film flexes away from said tray, said hot melt adhesive layer softens and releases said second bond between said upper surface of the lip and said film to expose said hole to gaseous communication between the hole and the recessed portion of the tray, thus enabling venting of the container, and such that said second bond between said upper surface of the lip and said film reforms upon the container cooling such that the hole is again sealed, preventing gaseous communication between the hole and the recessed portion of the container.

2. A container according to claim 1 wherein the layer is deposited on the film.

3. A container according to claim 1 wherein the layer is deposited on the lip.

4. A container according to claim 1, wherein the product is a foodstuff.

5. A container according to claim 1, the lip also has an outer edge wherein the layer is closer to the inner edge of the lip than to the outer edge.

* * * * *